United States Patent [19]

Williamson

[11] Patent Number: 4,849,734

[45] Date of Patent: Jul. 18, 1989

[54] SELF-DIAGNOSTIC CIRCUIT FOR ALARM-SYSTEMS

[75] Inventor: Gary L. Williamson, North Palm Beach, Fla.

[73] Assignee: Self Diagnostic Security Devices, Inc., Riviera Beach, Fla.

[21] Appl. No.: 85,770

[22] Filed: Aug. 17, 1987

[51] Int. Cl.[4] ..... G08B 29/00

[52] U.S. Cl. ..... 340/506; 340/508; 340/512; 340/513

[58] Field of Search ..... 340/506, 508, 512–514, 340/540, 539

[56] References Cited

U.S. PATENT DOCUMENTS

| | | | |
|---|---|---|---|
| 3,171,116 | 2/1965 | Conigliaro . | |
| 3,314,081 | 4/1967 | Atkins et al. | 4/100 |
| 3,530,455 | 9/1970 | Ressler . | |
| 3,611,362 | 10/1971 | Scott | 340/409 |
| 3,766,537 | 10/1973 | MacFarlane . | |
| 3,848,242 | 11/1974 | Campagna | 340/274 |
| 3,924,256 | 12/1975 | Cohen . | |
| 3,978,466 | 8/1976 | Simon . | |
| 4,060,803 | 11/1977 | Ashworth, Jr. | 340/506 |
| 4,065,762 | 12/1977 | Walter | 340/285 |
| 4,270,121 | 5/1981 | Verr . | |
| 4,303,909 | 12/1981 | Martin | 340/543 |
| 4,361,833 | 11/1982 | Allgood | 340/508 |
| 4,364,030 | 12/1982 | Rossin | 340/567 |
| 4,507,654 | 3/1985 | Stolarczyk et al. | 340/545 |
| 4,559,527 | 12/1985 | Kirby | 340/545 |
| 4,625,198 | 11/1986 | Williamson et al. | 340/512 |

FOREIGN PATENT DOCUMENTS

| | | |
|---|---|---|
| 1265001 | 3/1968 | Fed. Rep. of Germany . |
| 1566823 | 4/1970 | Fed. Rep. of Germany . |
| 2038061 | 7/1980 | United Kingdom . |
| 2137790 | 10/1984 | United Kingdom . |

*Primary Examiner*—Donnie L. Crosland
*Attorney, Agent, or Firm*—Steele, Gould & Fried

[57] ABSTRACT

A self-diagnostic circuit for use in alarm systems and the like, of the kind having a plurality of alarm detection switches connected in a loop, indicators associated with each of the switches for indicating locally the detection of an alarm condition and a central controller for reversing voltage polarity in the loop whenever an alarm condition is detected by one of the switches. The self-diagnostic circuit comprises: a first switch for detecing an alarm condition connected in an alarm loop; a second switch automatically activatable in response to operation of the first switch; an alarm indicator automatically operable in response to activation of the second switch; and, an automatically operable circuit for preventing deactivation of the second switch until after diagnosis of alarm system operation, even when the first switch no longer detects the alarm condition. Any such first switch exhibiting erratic switching behavior can be easily identified by continued operation of the associated alarm indicator.

22 Claims, 2 Drawing Sheets

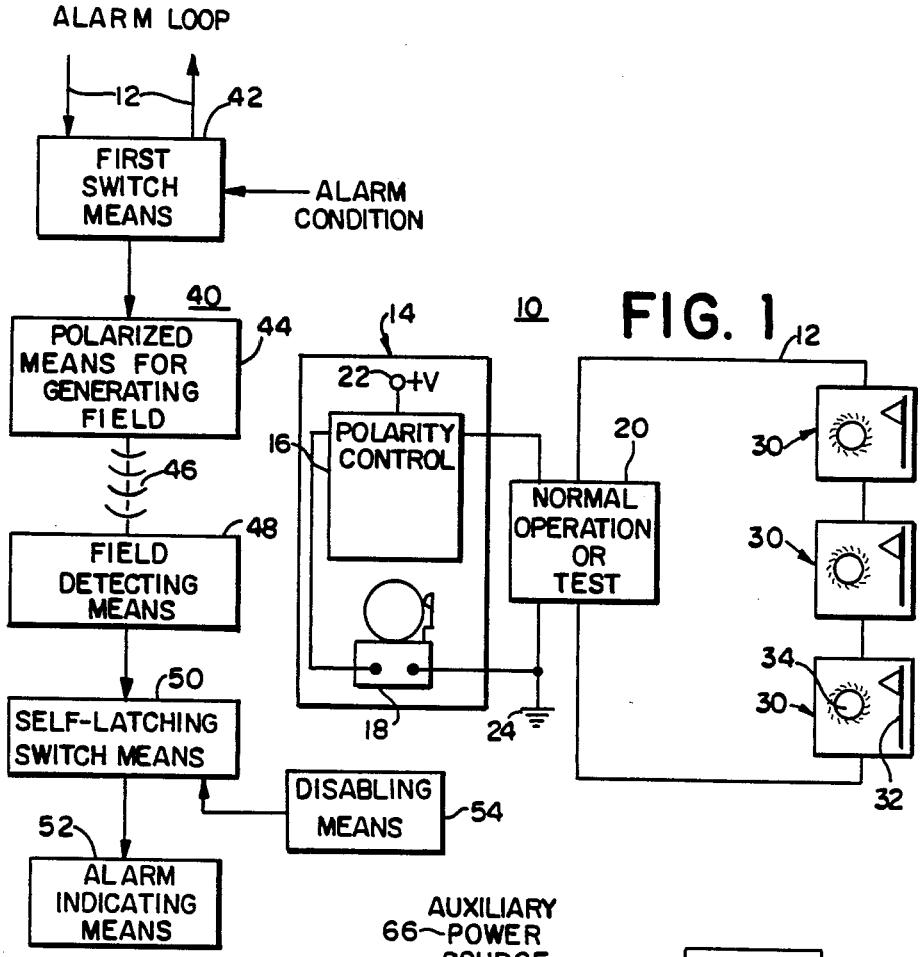
FIG. 1
FIG. 2
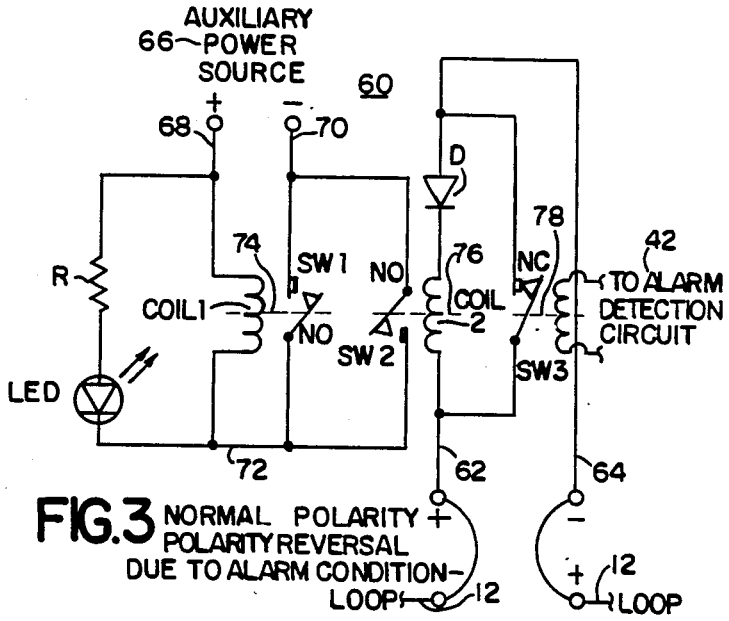
FIG.3 NORMAL POLARITY
POLARITY REVERSAL DUE TO ALARM CONDITION

SELF-DIAGNOSTIC CIRCUIT FOR ALARM-SYSTEMS

BACKGROUND OF THE INVENTION 1. Field of the Invention

This invention relates to the field of self-diagnostic circuits for use in alarm systems and the like, whereby alarm switch means exhibiting erratic switching behavior can be easily identified. More particularly, the invention relates to self-diagnostic circuits for use in alarm systems and the like, or the kind having a plurality of alarm detection switches connected in a loop, means associated with each of the switches for indicating locally the detection of an alarm condition and central control means for reversing voltage polarity in the loop wherever an alarm condition is detected by one of the switches. 2. Prior Art The self-diagnostic circuit according to this invention is particularly adapted for use in alarm systems and the like, of the kind having a plurality of alarm detection switches connected in a loop, means associated with each of the switches for indicating locally the detection of an alarm condition and central control means for reversing voltage polarity in the loop wherever an alarm condition is detected by one of the switches. Such an alarm system is disclosed in U.S. Patent No. 4,625,198. The alarm system disclosed therein comprises: a plurality of normally-closed electrical contacts wired in series with one another and further connected in series, when in an operating mode, with an alarm condition enunciator. Each of the contacts is mountable at a location to be monitored and is adapted to be opened by occurrence of an alarm condition, the enunciator being operative upon an open-circuit condition at any of said plurality of contacts. The enunciator has electrical polarizing means defining a forward current direction for the series wired contacts in the operating mode. A plurality of individual indicator means are wired one each in parallel with each of said electrical contacts, the individual indicator means having an operational bias means defining an electrical polarity opposite the electrical polarity of the enunciator, whereby a forward current flowing through the series wired contacts will not activate any of the indicator means. Switch means are operable in a test mode to disconnect the enunciator and apply to the series wired contacts a test voltage at a polarity opposite the electrical polarity of the enunciator and cause a reverse current to flow through the series wired contacts, whereby each of a plurality of electrical contacts then in said open-circuit condition is identified by activation of the individual indicator means wired in parallel therewith. The referenced patent also discloses a diagnostic apparatus for use with an existing alarm network of the type described above, the diagnostic apparatus comprising: at least one indicator means connected in parallel with one of the electrical contacts, the indicator means having an operational bias means defining a polarity opposite to the polarity defined by the forward direction of the direct current through the enunciator and contacts; and, a switch operable in a test mode to disconnect the enunciator from the electrical contacts and apply to the series wired contacts an opposite-polarity test voltage to said electrical contacts and cause a reverse current to flow through the series wired contacts, whereupon the at least one indicator means is operable to show an open circuit condition in the electrical contact associated with the at least one indicator means. The teachings of U.S. Patent No. 4,625,198 are entirely incorporated herein by reference.

The alarm system diagnostic apparatus described in the referenced patent provides a number of advantages, including means for easily determining the status of individual contacts in an alarm network and including the ability to identify whether a fault in operation of the alarm system is due to problems with one or more alarm switches or with the wiring connecting the various alarm switches, thereby significantly reducing the time and effort needed to diagnose and repair alarm systems. However, the diagnostic apparatus was incapable of identifying an intermittent but recurring switch fault. Such switch faults might result from broken switch contacts, accidental interruption of a light beam detector or the like, spurious light or sound sources or other randomly occurring events. The diagnostic apparatus is also incapable of identifying the location of an alarm condition after the alarm condition had ceased, and an automatic switch contact had returned to its normally closed position. This might occur if a burglar opened, and then closed a protected window, being scared away by the alarm.

This invention provides a self-diagnostic circuit for use in polarity reversing alarm systems such as those disclosed in the referenced patent, having alarm indicating means which remain active or operable even after an alarm condition ceases, whether or not the alarm condition was a bona fide alarm condition or resulted from spurious operation as described above.

The self-diagnostic circuit according to this invention will not only provide an alarm indicating means which is compatible with the earlier-patented alarm system diagnostic apparatus, but which can be used with so-called "two wire" or "four wire" alarm systems. Two wire alarm systems are those in which only the alarm loop is available for connecting and powering alarm detection switches and the like. The term two wire refers to the fact that each alarm switch or alarm switch circuit is connected to only two wires. In a four wire system, a separate or auxiliary power supply is available to power more sophisticated alarm detection devices, such as infrared detectors, motion sensors and the like. The self-diagnostic circuit according to this invention can be easily adapted for use with both kinds of alarm systems.

Various kinds of alarm systems, some of which include self-latching circuitry, are disclosed in the following United States patents: 3,171,116; 3,314,081; 3,530,455; 3,611,362; 3,766,537; 3,848,242; 3,924,256; 3,978,466; 4,065,762; 4,243,973; 4,303,909; 4,364,030; 4,507,654; and, 4,559,527. It is believed that none of the foregoing patent references discloses a self-diagnostic circuit which includes self-latching circuitry, and which is adapted for use in an alarm system of the kind characterized by central control means for reversing voltage polarity in a loop of series-connected alarm detection switches, each of the switches including means for indicating locally the detection of an alarm condition.

SUMMARY OF THE INVENTION

It is an object of this invention to provide a self-diagnostic circuit for use in alarm systems and the like.

It is another object of this invention to provide a self-diagnostic circuit for use in alarm systems and the like, of the kind having central control means for reversing voltage polarity in an alarm loop whenever an alarm condition is detected by one of a plurality of alarm detection switches connected in the loop.

It is still another object of this invention to provide a self-diagnostic circuit for use in alarm systems and the like, which will enable easy identification of any alarm detection switch exhibiting erratic switching behavior.

It is yet another object of this invention to provide a self-diagnostic circuit for use in alarm systems and the like, which enables easy identification of any alarm detection switch activated responsive to detection of an alarm condition, whether spurious or genuine, even after discontinuance of the alarm condition.

It is yet another object of this invention to provide a self-diagnostic circuit for use in alarm systems and the like, which is operable with both two wire and four wire alarm systems, that is, with both passive and active alarm detection devices.

These and other objects of this invention are accomplished by a self-diagnostic circuit for use in alarm systems and the like, of the kind having a plurality of alarm detection switches connected in a loop, means associated with each of the switches for indicating locally the detection of an alarm condition and central control means for reversing voltage polarity in the loop whenever an alarm condition is detected by one of the switches, the self-diagnostic circuit comprising: a first switch means for detecting an alarm condition connected in an alarm loop; a second switch means automatically activatable in response to operation of the first switch means; alarm indicating means automatically operable in response to activation of the second switch means; and, automatically operable means for preventing deactivation of the second switch means until after diagnosis of alarm system operation, even when the first switch means no longer detects the alarm condition, whereby any first switch means exhibiting erratic switching behavior can be easily identified by continued operation of the associated alarm indicating means. This self-diagnostic circuit may further comprise means for deactivating the automatically operable means. In the presently preferred embodiments, the self-diagnostic circuit comprises means for generating an electromagnetic field when the first switch means detects an alarm condition, the second switch means being activated in response to detection of the electromagnetic field. This self-diagnostic circuit may be embodied with semiconductor devices, such as optically coupled semiconductor switches, and may be embodied with conventional electrical components, such as relay coils and switches. In accordance with the adaption for use with alarm systems and the like having central control means for reversing voltage polarity in an alarm loop, the self-diagnostic circuit preferably comprises polarized means for generating the electromagnetic field. Such polarized means may be embodied by light emitting diodes or by relay coils connected in series with conventional diodes.

These and other objects of the invention will become apparent to those skilled in the art upon consideration of the following detailed description of the preferred embodiments.

BRIEF DESCRIPTION OF THE DRAWINGS

There are shown in the drawings forms which are presently preferred. It should be understood, however, that the invention is not limited to the precise arrangements and instrumentalities shown.

FIG. 1 is a schematic and block circuit diagram of an alarm system incorporating self-diagnostic circuits according to this invention;

FIG. 2 is a block diagram of a typical self-diagnostic alarm circuit according to this invention;

FIG. 3 is a circuit diagram of a self-diagnostic circuit according to this invention embodied with relay coils and relay switches, and adapted for use with a four wire system;

DETAILED DESCRIPTION OF THE PREFERRED EMBODIMENTS

Figure 4:
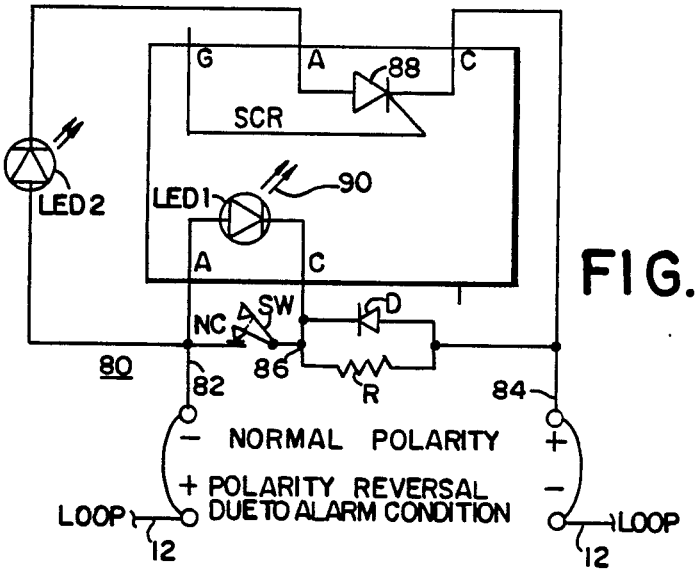
FIG. 4 is a circuit diagram of a self-diagnostic circuit according to this invention, embodied with a semiconductor switch, and adapted for use with a two wire system; and, FIG. 5 is a circuit diagram of the semiconductor switch circuit shown in FIG. 4, as adapted for use with a four wire system.

An alarm system 10 is shown schematically in FIG. 1. Alarm system 10 is of the kind having a plurality of alarm detection switches connected in series in a loop, means associated with each of the switches for indicating locally the detection of an alarm condition and a central control means for reversing voltage polarity in the loop whenever an alarm condition is detected by one of the switches. The alarm system 10, which corresponds generally to the alarm system described in U.S. Pat. No. 4,625,198, comprises an alarm loop 12 and a central control means 14. The central control means 14 comprises a polarity control switch 16 and an alarm enunciator, shown as an audible alarm 18. An operational mode switch 20 enables manual selection of normal operation or circuit testing. The polarity control means 16 is connected to a direct current voltage source having a first terminal 22 and a second terminal 24.

The alarm system further comprises a plurality of self-diagnostic circuits 30 according to this invention, each of which is provided with an alarm detection switch means 32 and an alarm indicating means 34, diagrammatically illustrated by a switch contact and light, respectively. Each of the self-diagnostic circuits 30 has a switch contact 32 connected in series in the loop 12. During normal operation, a positive voltage is applied to terminal 22 and ground is applied to terminal 24. Whenever an alarm condition is detected, one or more of the switch contacts 32 will open. The interruption of current flowing through the loop 12 is detected by the polarity control means 16, which responsive to such a detection of an alarm condition, effects a polarity reversal. The polarity reversal causes the respective indicating means 34 of the open contact switch to light. The mode of operation switch 20 enables the voltage polarity to be reversed in the absence of an alarm condition, as more fully explained in U.S. Pat. No. 4,625,198.

The principal components of a self-diagnostic circuit are shown in block diagram form in FIG. 2, the self-diagnostic circuit being generally designated by reference numeral 40. A first switch means 42 includes a normally closed switch contact connected in series in the loop 12. Upon detection of an alarm condition, the switch contact (the first switch means) will open. Generally speaking, if the alarm condition is discontinued, the switch contact will close. Accordingly, the intermittent operation of such a switch contact is not normally traceable to a particular first switch means. Under certain circumstances, it is more convenient to have a parallel circuit of normally open contact switches, which would close upon detection of an alarm condition. Such switches can be incorporated into a self-diagnostic circuit according to this invention. Activation of the first switch means 42, which for purposes of convenience will hereafter be referred to as the opening of a normally closed switch contact, activates or otherwise enables operation of a polarized means 44 for generating an electromagnetic field. The electromagnetic field might be the magnetic field of a relay coil connected in series with a diode, the visible light of a light emitting diode or the invisible light of an infrared light emitting diode, or the like. The polarized means 44 for generating an electromagnetic field might even include means for generating radio frequency waves. It will be apparent to those skilled in the art that, under certain circumstances, even an acoustical field might be utilized in place of an electromagnetic field.

Irrespective of the particular nature of the radiated field 46, a means 48 for detecting the field 46 actuates or otherwise enables operation of a self-latching switch means 50. The self-latching switch means 50 operates independently of the first switch means and independently of the polarized means 44, whereby the self-latching switch means will remain activated, actuated or otherwise operable even if the first switch means 42 no longer detects an alarm condition. An alarm indicating means 52 is activated responsive to operation of the self-latching switch means 50, and the alarm indicating means 52 will remain activated unless and until the self-latching switch means 50 is intentionally deactivated or disabled by means 54, which may be as simple as a push button switch. Accordingly, the alarm indicating means 52 of a self-diagnostic circuit in which the first switch means 42 exhibits erratic switching behavior, will remain lit until the alarm indicating means can be visually observed. After the self-diagnostic circuit which is malfunctioning has been so identified, it can be repaired or replaced, and the alarm system can be reactivated. Reactivation of the alarm system includes returning the voltage polarity in the loop 12 to its normal condition.

A first embodiment of a self-diagnostic circuit according to this invention is shown in FIG. 3 and generally designated by reference numeral 60. The self-diagnostic circuit 60 is of the kind utilizing relay coils and switch contacts. Self-diagnostic circuit 60 is also of the kind adapted for use with a four wire system, that is, a system having an auxiliary power source, such as would be necessary to operate an infrared detector. Such an infrared detector would be provided with a COIL 3 having a normally closed switch contact SW3. A first portion of the self-diagnostic circuit 60 includes a diode D in series with a COIL 2, the series combination of the diode D and COIL 2 being connected in parallel with the normally closed switch contact SW3. The diode D and COIL 2 form a polarized means for generating a magnetic field 76. The circuit which includes diode D, COIL 2, and switch contact SW3 is itself connected in series to the loop 12 by terminals 62 and 64. The normal voltage polarity in the loop is so noted, and indicates the voltage polarity in the absence of an alarm condition. The opposite polarity, designated as polarity reversal due to alarm condition, reflects the polarity in the loop after an alarm condition has been detected, by reason of the series circuit being interrupted by the opening of the normally closed switch contact SW3. During normal operation, and normal voltage polarity in the loop, the normally closed switch contact SW3 presents a short circuit around the diode D and COIL 2. Moreover, diode D is reverse biased in the normal polarity condition, and no current can flow through COIL 2. Switch contact SW3 opens and closes responsive to the presence or absence of field 78, generated by COIL 3, which forms part of a first switch means 42 for detecting an alarm condition.

A second part of self-diagnostic circuit 60 comprises an auxiliary power source 66 having positive and negative terminals 68 and 70 respectively. A first branch of the circuit is connected between positive terminal 68 and node 72. A second branch is connected between node 72 and negative terminal 70. The first branch comprises a resistor R connected in series with a light emitting diode LED, the series connected components being connected in parallel with relay COIL 1. The light emitting diode LED forms an alarm indicating means 52, and resistor R limits the current flowing therethrough. The second branch comprises a normally open relay switch contact SW1 connected in parallel with a normally open relay switch contact SW2. Switch contact SW1 operates responsive to a field 74 generated by COIL 1. Switch contact SW2 operates responsive to a field 76 generated by COIL 2.

During normal operation of self-diagnostic circuit 60, in the absence of an alarm condition, switch contact SW3 is closed and switch contacts SW1 and SW2 are open. Accordingly, a short circuit is effectively presented to the loop 12 and no current flow through either the light emitting diode LED or COIL 1. Upon detection of an alarm condition, current will flow through the coil associated with SW3, which generates field 78, which in turn opens the normally closed switch contact SW3.

When switch contact SW3 opens, diode D is still reversed biased. Accordingly, an open-circuit condition is imposed on the loop 12. In accordance with the normal operation of such alarm systems, the voltage polarity in the loop 12 is reversed upon detection of the open-circuit condition. When the voltage polarity reverses, diode D is forward biased, and current flows through COIL 2, generating field 76. The generation of field 76 causes the normally open switch contact SW2 to close. When switch contact SW2 closes, current flows through resistor R and light emitting diode LED on the one hand, and COIL 1 on the other hand. Current flowing through COIL 1 generates field 74, which in turn closes the normally open switch contact SW1. As long as an alarm condition continues to be detected and the voltage polarity in the loop 12 remains reversed, current will continue to flow through COILS 1, 2 and 3, switch contacts SW1 and SW2 will remain closed and switch contact SW3 will remain open, and light emitting diode LED will remain lit. Eventually, one of two alternatives will take place; either, (1) the alarm condition will stop while the voltage polarity in the loop 12 remains reversed; or, (2) the voltage polarity in the loop 12 will return to its normal condition before the alarm condition stops.

In the first alternative, where the alarm condition is no longer detected but the voltage polarity remains reversed, current will stop flowing through the coil associated with SW3, field 78 will collapse and switch contact SW3 will close. Even though diode D remains forward biased, diode D and COIL 2 will be shorted out by switch contact SW3, no current will flow through COIL 2, and field 76 will collapse. When field 76 collapses, switch contact SW2 will open. However, current will continue to flow through resistor R, light emitting diode LED and COIL 1. The current flowing through COIL 1 will maintain field 74, which will continue to hold switch contact SW1 closed. Accordingly, the light emitting diode LED will remain lit until power from the auxiliary power source 66 is interrupted, by a switch or other suitable means (not shown). Accordingly, a survey of the alarm system will enable the specific self-diagnostic circuit which was activated to be identified, even after the alarm condition is no longer detected, whether such alarm detection was due to a bona fide alarm or whether such alarm condition was due to faulty switch operation or the like. Even if the voltage polarity in the loop 12 is thereafter returned to its normal condition, diode D and COIL 2 will remain shorted out by switch contact SW3, and the light emitting diode LED will remain lit. When the power is finally interrupted, no current flows through COIL 1, field 74 collapses and switch contact SW1 opens.

In the second alternative, where the voltage polarity in the loop 12 is returned to its normal condition notwithstanding the continued detection of an alarm condition, diode D will become reverse biased and current will stop flowing through COIL 2, causing field 76 to collapse, and in turn causing switch contact SW2 to open. Nevertheless, as explained above, light emitting diode LED will remain lit. Shortly thereafter, however, the open circuit caused by switch contact SW3 will be redetected, and voltage polarity in the loop will reverse once again. Accordingly, even if the voltage polarity is accidentally returned to its normal condition prior to diagnosis and system inspection, the activated self-diagnostic circuit can still be easily identified. In summary, the light emitting diode LED will remain lit, once activated, until the auxiliary power source is interrupted, irrespective of the detection or failure to detect an alarm condition and irrespective of the voltage polarity in the loop 12.

The self-diagnostic circuit 80 shown in FIG. 4 utilizes an optically coupled silicon controlled rectifier SCR. Such an optically coupled silicon controlled rectifier includes an anode (A)-cathode (C) junction 88 controlled by a gate contact G, which is responsive to an electromagnetic field 90 generated by light emitting diode LED1. Such optically coupled semiconductor switches frequently operate by infrared light, rather than by visible light. The self-diagnostic circuit 80 is connected to the loop 12 by terminals 82 and 84. A normally closed alarm switch SW is connected in parallel with the gate-controlling, light emitting diode LED1. A light emitting diode LED2 is connected between the anode of light emitting diode LED1 and the anode of anode-cathode junction 88. A diode D and a resistor R are connected in parallel with one another, the parallel circuit being connected between terminal 84 and node 86, node 86 corresponding to the cathode of light emitting diode LED1 and terminal 84 being connected to the cathode of anode-cathode junction 88. Light emitting diode LED2 forms the alarm indicating means.

During normal operation, in the absence of an alarm condition, switch contact SW is normally closed, shorting out light emitting diode LED1. In the absence of field 90, the anode-cathode junction 88 does not conduct, and no current flows through light emitting diode LED2. At the same time, diode D is forward biased, shorting out resistor R. Accordingly, the self-diagnostic circuit 80 presents a no load, short circuit on loop 12.

Upon detection of an alarm condition, switch contact SW opens. Although light emitting diode LED is no longer shorted out, it is still reverse biased and does not light. Light emitting diode LED2 and anode-cathode junction 88 are also reverse biased, and do not conduct current. The resulting open-circuit condition is detected, and the voltage polarity in the loop 12 is automatically reversed. Reversal of the polarity in loop 12 places light emitting diode LED 1 in a forward biased condition. Although diode D is now reverse biased, a circuit path is available through resistor R. Accordingly, light emitting diode LED1 generates field 90, which in turn causes the anode-cathode junction 88 of the semiconductor switch to conduct. The current flowing through the anode-cathode junction 88 also flows through light emitting diode LED2, which lights and serves as an alarm indicating means.

If the alarm condition is no longer detected, switch contact SW will close, shorting out light emitting diode LED1, causing field 90 to collapse. However, diode D will remain reverse biased and present an open-circuit; causing current in the loop 12 to flow through resistor R. The current flowing through resistor R, and the resulting voltage drop thereacross are sufficient to maintain a current flowing through light emitting diode LED2 and anode-cathode junction 88. This situation will continue, irrespective of the opening and closing of switch contact SW, unless and until the voltage polarity in the loop is returned to its normal condition, which will place the anode-cathode junction 88 in a reverse bias condition, and so turn the junction (switch) off.

Although the self-diagnostic circuit 80 is not insensitive to voltage polarity in the loop subsequently returning to normal, as is the case with self-diagnostic circuit 60, the self-diagnostic circuit 80 has the advantages of being operable with a two wire system and requiring no separate auxiliary power source for operation. The effect of diode D across resistor R is to effectively make the self-diagnostic circuit 80 a no-load circuit during normal operation in the absence of an alarm condition. Diode D and resistor R together form a polarized resistance.

Figure 5:
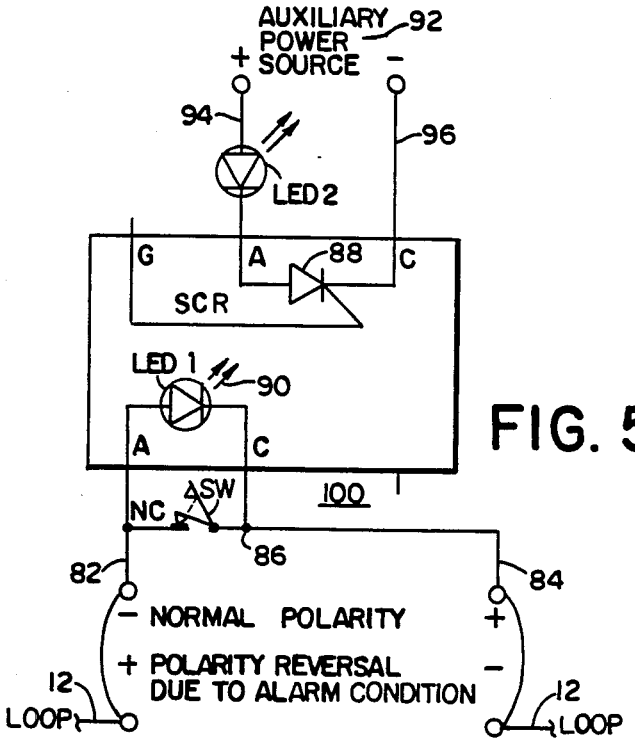

An optically coupled semiconductor switch can also be embodied in a self-diagnostic circuit adapted for use with a four wire system as shown in FIG. 5, wherein like components are designated by the same reference numerals as in FIG. 4. The self-diagnostic circuit 100 is also based upon an optically coupled silicon controlled rectifier SCR. The light emitting diode LED2 is still connected in series with the anode-cathode junction 88. However, both light emitting diode LED2 and anode-cathode junction 88 are connected in a forward biased condition with respect to auxiliary power source 92, having positive terminal 94 and negative terminal 96. The light emitting diode LED1 is still connected in parallel with the switch contact SW, and is connected in reverse bias condition with respect to the normal voltage polarity in loop 12. Diode D and resistor R are unnecessary, and node 86 is identical with terminal 84. There are no connections between the circuit incorporating the light emitting diode LED2 on the one hand and the loop 12 or the light emitting diode LED1 on the other hand.

In the normal operating condition, and in the absence of an alarm condition, switch contact SW is normally closed, shorting out light emitting diode LED1. Upon detection of an alarm condition, switch contact SW opens, but light emitting diode LED1 remains reverse biased. The open-circuit condition is detected, and the voltage polarity in the loop 12 is reversed responsive to detection of the open-circuit condition. As light emitting diode LED1 becomes forward biased, field 90 is generated, either in visible light or infrared light. The generation of field 90 causes the anode-cathode junction 88 to conduct, the current flowing therethrough also flowing through light emitting diode LED2, which visually signals an alarm condition. As is the case with all typical silicon controlled rectifiers, the anode-cathode junction 88 will continue to conduct until a sufficiently large reverse bias is applied thereto or until the current flowing therethrough is otherwise interrupted. Accordingly, light emitting diode LED2 will remain lit irrespective of further opening and closing of the switch contact SW and further voltage polarity reversals in the loop 12. Light emitting diode LED2 will remain lighted unless and until power from the auxiliary power source 92 is interrupted.

It will be appreciated by those skilled in the art that self-diagnostic circuits according to this invention can be embodied in a number of specific forms, wherein normally open contacts are substituted for normally closed contacts, normally closed contacts are substituted for normally open contacts, relays are substituted for semiconductor switches, semiconductor switches are substituted for relay switches, light sources in series with diodes are substituted for light emitting diodes, and the like. Moreover, and as has been demonstrated, it will be appreciated that different kinds of electromagnetic fields in various spectral ranges can be utilized. Switches and switching junctions utilizing directly wired gate control can also be utilized, although such circuits will be more complicated in order to compensate for leakage currents, impedance matches and the like. Field coupling as used in this invention between alarm detecting means and self-latching switch means provides for very clean, very efficient operation with simple inexpensive circuit elements. Such field coupling also assures reliable operation. Accordingly, reference should be made to the appended claims, rather than to the foregoing specification, as indicating the scope of the invention.

What is claimed is:

1. A self-diagnostic circuit for use in alarm systems and the like of the kind having a plurality of alarm detection switches connected in an alarm loop, alarm indicating means being associated with individual ones of the alarm detection switches and indicating detection of an alarm condition locally for a corresponding one of the alarm detection switches, and central control means operable to reverse voltage polarity in the loop whenever an alarm condition is detected by one of the alarm detection switches in the loop, the self-diagnostic circuit comprising:

at least one of the alarm detection switches having a first switch means operable upon occurrence of an alarm condition, the first switch means being connected in the alarm loop;

a second switch means automatically activated in response to operation of the first switch means;

an alarm indicating means automatically activated in response to activation of the second switch means; and, automatically operable means for preventing deactivation of the second switch means at least while the voltage polarity in the alarm loop is reversed, thereby maintaining activation of the alarm indicating means for diagnosis of the alarm system operation by identifying which of the alarm detection switches had been operated, the second switch means latching to remain activated even when the first switch means no longer detects the alarm condition, whereby any first switch means exhibiting erratic switching behavior can be easily identified by continued operation of its associated alarm indicating means.

2. The self-diagnostic circuit of claim 1, further comprising means for deactivating the automatically operable means.

3. A self-diagnostic circuit of claim 1, wherein the first switch means is one of a plurality of said first switch means connected in series in the alarm loop.

4. The self-diagnostic circuit of claim 1, wherein the second switch means is coupled to the first switch means by an electromagnetic field.

5. The self-diagnostic circuit of claim 1, wherein the alarm indicating means is a light emitting means.

6. The self-diagnostic circuit of claim 1, further comprising means for generating an electromagnetic field when the first switch means detects an alarm condition and wherein the second switch means is activated in response to the electromagnetic field.

7. The self-diagnostic circuit of claim 6, further comprising polarized means for generating the electromagnetic field, said polarized means being operable only for voltage at one of two opposite polarities.

8. The self-diagnostic circuit of claim 7, wherein the polarized means comprises a diode.

9. The self-diagnostic circuit of claim 6, wherein the electromagnetic field generating means is connected in parallel with the first switch means.

10. The self-diagnostic circuit of claim 6, wherein the electromagnetic field generating means comprises a light emitting diode.

11. The self-diagnostic circuit of claim 7, wherein the polarized means comprises a light emitting diode.

12. The self-diagnostic circuit of claim 9, wherein the electromagnetic field generating means comprises a light emitting diode.

13. The self-diagnostic circuit of claim 6, comprising an optically coupled semiconductor switch, the semiconductor switch forming both the means for generating an electromagnetic field and the second switch means.

14. The self-diagnostic circuit of claim 13, comprising:

an anode-cathode junction controlled by an optically coupled gate, the anode-cathode junction conducting current according to a forward polarity when activated;

a light emitting diode connected in series with the anode-cathode junction and operable to conduct current in a forward direction at the same forward polarity as the anode-cathode junction, the light emitting diode forming the alarm indicating means; and, a polarized resistance enabling continued conductance of current through the anode-cathode junction during polarity reversal in the loop and presenting an effective short circuit during current according to a normal polarity opposite said forward direction of the anode-cathode junction and light emitting diode in the loop.

15. The self-diagnostic circuit of claim 14, wherein the polarized resistance comprises a resistor and a diode connected in parallel.

16. The self-diagnostic circuit of claim 14, wherein the first switch means and the polarized resistance are connected in series in the loop, the polarized resistance presenting an effective short circuit when the polarity of the loop is normal and the first switch means is closed and the polarized resistance presenting a resistance in the loop when the first switch means has opened and subsequently closed, but polarity in the loop remains reversed, whereby a resulting voltage potential across the resistance is sufficient to ensure continued current flow through the anode-cathode junction and through the light emitting diode forming the alarm indicating means until the polarity in the loop is returned to normal.

17. The self-diagnostic circuit of claim 6, wherein the electromagnetic field generating means comprises a relay coil in series with a diode.

18. The self-diagnostic circuit of claim 17, wherein the polarized means comprises a relay coil in series with a diode.

19. The self-diagnostic circuit of claim 9, wherein the electromagnetic field generating means comprises a relay coil in series with a diode.

20. The self-diagnostic circuit of claim 13, wherein the semiconductor switch has an anode-cathode junction controlled by an optically coupled gate and a gate control formed by a light emitting diode formed integrally therewith, and further comprising:

a light emitting diode, forming the alarm indicating means, connected in series with the anode-cathode junction, each of the light emitting diode and the anode-cathode junction being connected in forward bias with respect to an auxiliary power supply; and, the integrally formed light emitting diode being connected in parallel with the first switch means and forming the electromagnetic field generating means.

21. A self-diagnostic circuit for use in alarm systems and the like, of the kind having a plurality of alarm detection switches connected in a loop, means associated with each of the switches for indicating detection of an alarm condition locally at the switches, and central control means for reversing voltage polarity in the loop whenever an alarm condition is detected by one of said switches, the self-diagnostic circuit comprising:

a first switch means for detecting an alarm condition, the first switch means being connected in the alarm loop;

a first relay having a first coil in series with a diode, connected in forward bias with respect to a normal voltage polarity in the loop, the first coil and the diode being connected in parallel with the first switch means and the first coil having a first contact switch, normally open, operatively associated therewith;

a second switch means automatically activatable in response to operation of the first switch means;

an alarm indicating means automatically operable in response to activation of the second switch means; and, automatically operable means for preventing deactivation of the second switch means, permitting diagnosis of alarm system operation even when the first switch means no longer detects the alarm condition, whereby any first switch means exhibiting erratic switching behavior can be easily identified by continued operation of the associated alarm indicating means, said automatically operable means including a second relay having a second coil in parallel with a light emitting means, the second coil and the light emitting means having a first junction connected to a first terminal of an auxiliary power source, and the second coil having a second contact switch forming part of said second switch means, normally open, operatively associated therewith; and, the first and second contact switches being connected in parallel, between a second junction of the light emitting means and the second coil, on the one hand, and a second terminal of the auxiliary power supply, on the other hand, whereby sufficient current flows through the second coil and the light emitting means, by a path through the second contact switch, to ensure that the light emitting means remains lighted even if the first contact switch subsequently closes, the light emitting means remaining lighted until power from the auxiliary power source is interrupted.

22. The self-diagnostic circuit of claim 21, wherein the light emitting means comprises a light emitting diode, connected in forward bias with respect to the voltage polarity of the auxiliary power supply.

* * * * *